US008418899B1

(12) United States Patent
Stamps

(10) Patent No.: US 8,418,899 B1
(45) Date of Patent: Apr. 16, 2013

(54) FISHING POLE HOLDER HARNESS

(76) Inventor: Timothy M. Stamps, Humble, TX (US)

( * ) Notice: Subject to any disclaimer, the term of this patent is extended or adjusted under 35 U.S.C. 154(b) by 137 days.

(21) Appl. No.: 12/960,247

(22) Filed: Dec. 3, 2010

Related U.S. Application Data

(60) Provisional application No. 61/267,925, filed on Dec. 9, 2009.

(51) Int. Cl.
*A45F 3/04* (2006.01)

(52) U.S. Cl.
USPC ..... 224/251; 224/262; 224/922

(58) Field of Classification Search ..... 224/922, 224/190, 251, 262, 637, 257, 913, 917
See application file for complete search history.

(56) References Cited

U.S. PATENT DOCUMENTS

| | | | | | |
|---|---|---|---|---|---|
| 1,198,202 | A | | 9/1916 | Drinkard | |
| 2,271,136 | A | | 1/1942 | Geiger | |
| 2,954,909 | A | * | 10/1960 | Miller et al. | 224/200 |
| 3,204,650 | A | * | 9/1965 | Shinew | 135/16 |
| 4,982,883 | A | * | 1/1991 | Ullal et al. | 224/651 |
| 5,511,336 | A | * | 4/1996 | Bishop | 43/21.2 |
| 5,620,119 | A | * | 4/1997 | Keller | 224/190 |
| 5,961,014 | A | * | 10/1999 | Knerr | 224/259 |
| 5,975,393 | A | * | 11/1999 | Bellamy | 224/655 |
| 6,179,175 | B1 | * | 1/2001 | Painter | 224/153 |
| 6,216,931 | B1 | * | 4/2001 | Trawinski | 224/583 |
| D461,521 | S | * | 8/2002 | Krueger | D22/147 |
| 6,435,390 | B1 | * | 8/2002 | Abramowicz | 224/629 |
| 6,591,540 | B1 | | 7/2003 | Chargois | |
| 6,772,440 | B1 | | 8/2004 | Foster | |
| 6,923,357 | B2 | * | 8/2005 | Smith | 224/605 |
| 6,931,782 | B1 | * | 8/2005 | Pitcock | 43/21.2 |
| 7,275,668 | B1 | * | 10/2007 | Carroll | 224/190 |
| 2005/0145663 | A1 | | 7/2005 | Samuels | |
| 2007/0295774 | A1 | * | 12/2007 | Matschke | 224/581 |
| 2008/0203127 | A1 | * | 8/2008 | Castillo-Garrison | 224/607 |
| 2010/0288806 | A1 | * | 11/2010 | Wier | 224/257 |

* cited by examiner

*Primary Examiner* — Justin Larson

(57) ABSTRACT

A fishing pole holder harness including an adjustable waist strap, adjustable shoulder straps, an adjustable front chest strap and first rear strap attached to the shoulder straps. The waist and shoulder straps and the front and first rear straps are formed of high-strength 2-inch and 1-inch webbing, respectively. Each of the waist and front chest straps has a centrally disposed buckle. Attachment means for fishing accessories include grommets disposed on the waist strap; a second attachment body, which is a buckle female portion, disposed on each of the shoulder straps above the front chest strap; and a D-ring attached to a securement strap having an opposite buckle male portion removably attached to a lower end of each second attachment body. At least one hollow cylindrical holder tube is attached to the shoulder straps rearward side. A tackle box is alternately removably attached to the second attachment body.

13 Claims, 4 Drawing Sheets

FISHING POLE HOLDER HARNESS

CROSS-REFERENCE TO RELATED APPLICATIONS

U.S. Provisional Application No. 61/267,925 filed on Dec. 9, 2009

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of fishing accessories are known in the prior art. However, what is needed is a fishing pole holder harness including a harness worn by a fisherman, the device including an adjustable waist strap, a pair of adjustable shoulder straps, an adjustable front chest strap attached to the shoulder straps, and a first rear strap attached to the shoulder straps and also including at least one hollow cylindrical holder tube attached to the shoulder straps proximal to the first rear strap.

FIELD OF THE INVENTION

The present invention relates to fishing accessories, and more particularly, to a fishing pole holder harness.

SUMMARY OF THE INVENTION

The general purpose of the present fishing pole holder harness, described subsequently in greater detail, is to provide a fishing pole holder harness which has many novel features that result in a fishing pole holder harness which is not anticipated, rendered obvious, suggested, or even implied by prior art, either alone or in combination thereof.

To accomplish this, the present fishing pole holder harness is designed to carry at least one fishing pole formed of a rod and reel as well as other fishing accessories. The instant fishing pole holder harness includes an adjustable waist strap, a pair of adjustable shoulder straps, an adjustable front chest strap attached to the shoulder straps, and a first rear strap attached to the shoulder straps. The waist strap and shoulder straps are formed of high-strength 2-inch webbing while the front chest strap and the first rear strap are formed of high-strength 1-inch webbing. The waist strap has a 2-inch buckle centrally disposed on a front side thereof. The front chest strap has a 1-inch buckle centrally disposed thereon. A plurality of grommets is disposed in the waist strap for attaching accessories. A second attachment body having a buckle female portion of a 1-inch buckle is disposed on each of the shoulder straps in a position above the front chest strap also for attaching accessories to the present device. A D-ring is attached to a strap having a buckle male portion on an opposite end thereof that engages the buckle female portion disposed on a lower end of each second attachment body to provide for the attachment of fishing accessories. At least one hollow cylindrical holder tube is attached to the shoulder straps proximal to the first rear strap. A tackle box is alternately removably attached to the buckle female portion disposed on at least one of the shoulder straps, as an alternative to a D-ring, to carry various fishing accessories such as hooks.

The instant fishing pole holder harness holds at least one fishing pole securely in a diagonal position to prevent a fishing pole from slipping out of the holder tube and in an elevated position against a user's body to protect the fishing pole and reel from the corrosive effects of saltwater and submergence, thus reducing equipment failure and replacement. The present device reduces the need to replace a fishing reel prematurely due to damage from saltwater. In addition, the fishing pole holder harness is lightweight and makes carrying a rod and reel easier by balancing the rod and reel on the angler's back so that the angler does not tire while fishing. The instant fishing pole holder harness enables the angler to carry other necessary fishing tools against the angler's body for convenient access. Further, the fishing pole holder harness may be used an unlimited number of times by users of varying sizes due to the adjustability of all straps.

Thus has been broadly outlined the more important features of the present fishing pole holder harness so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
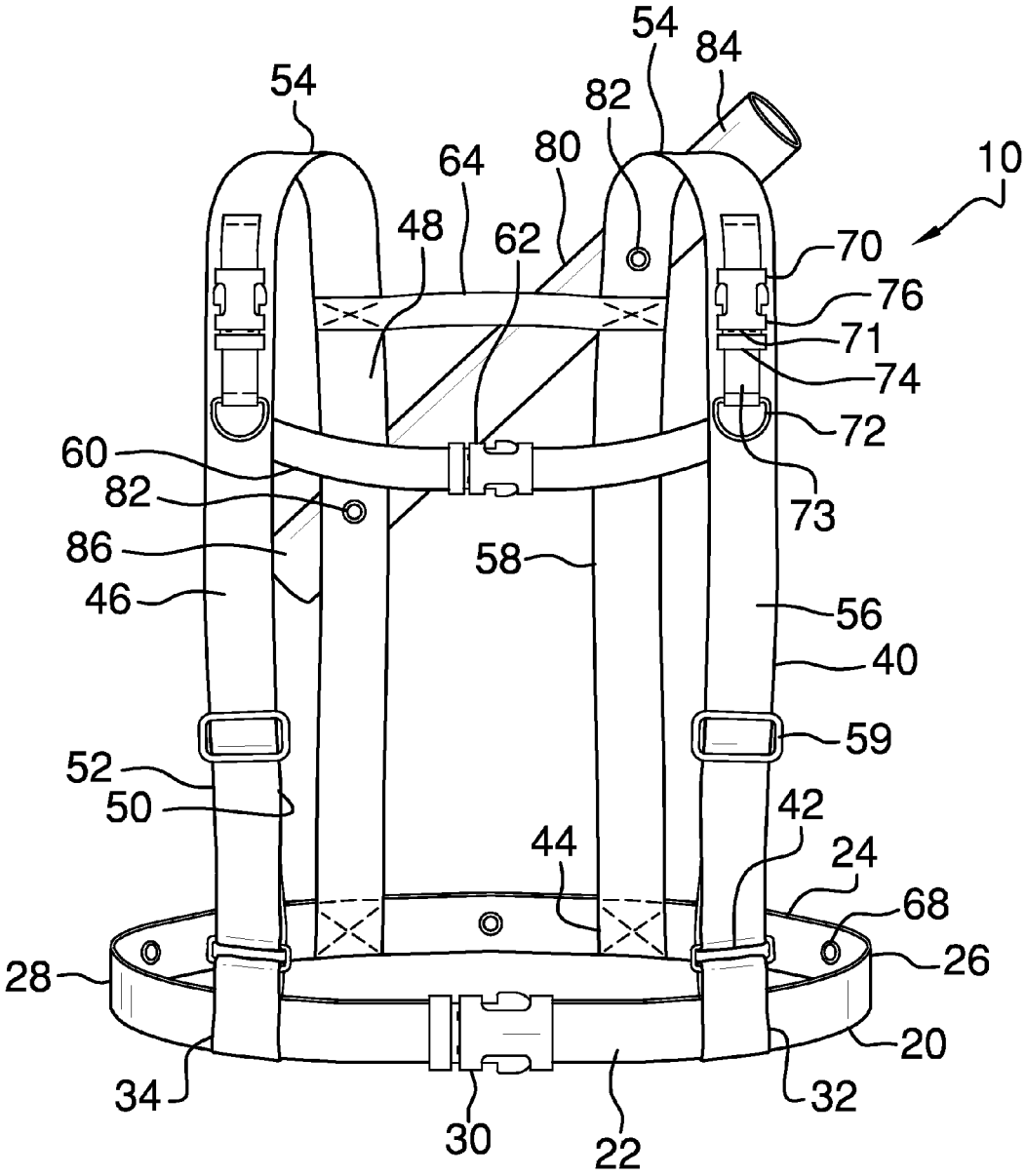
FIG. 1 is a front isometric view
Figure 2:
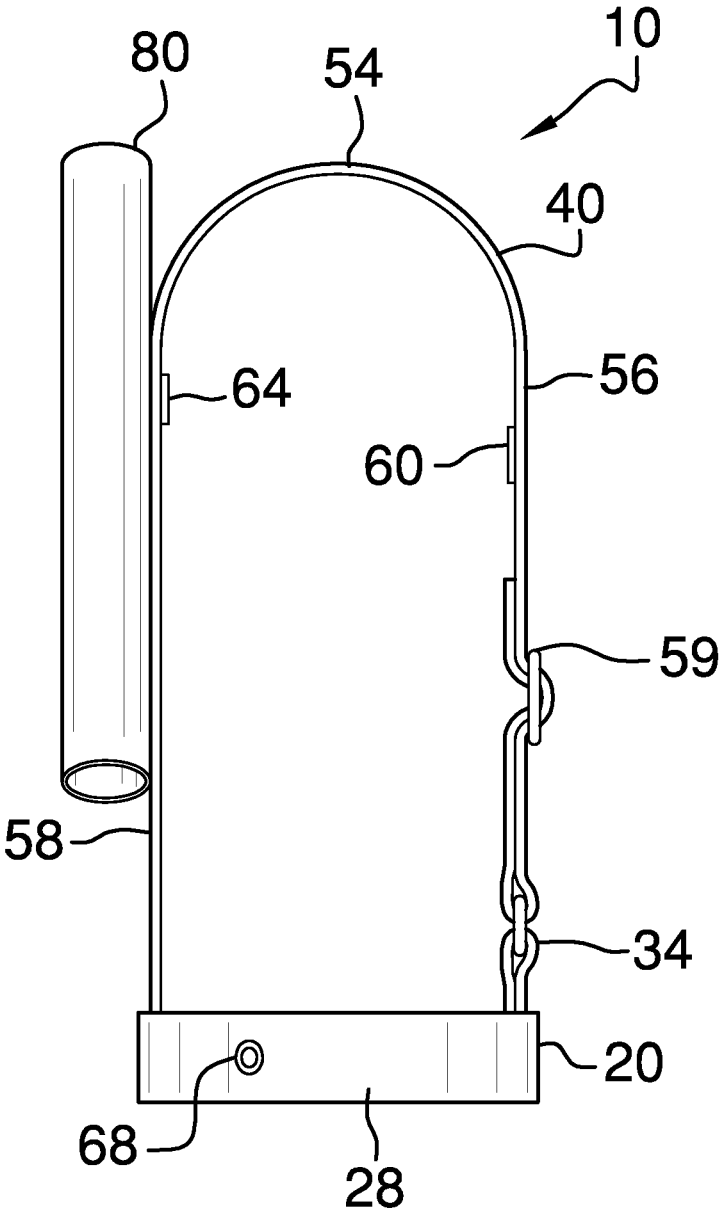
FIG. 2 is a side elevation view.
Figure 3:
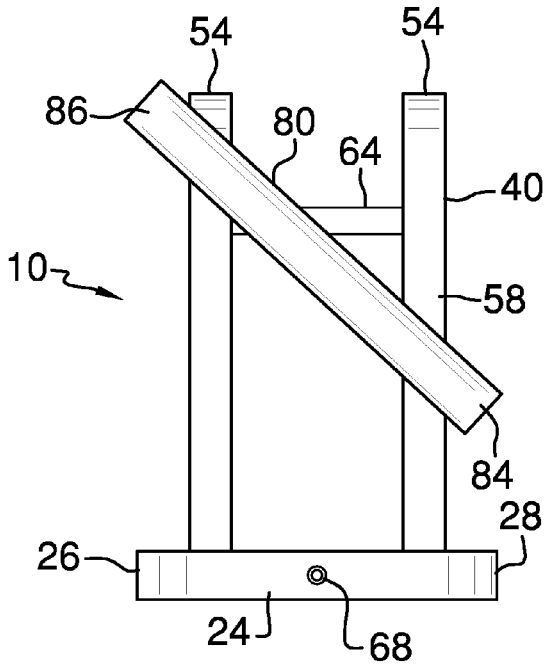
FIG. 3 is a rear elevation view.
Figure 4:
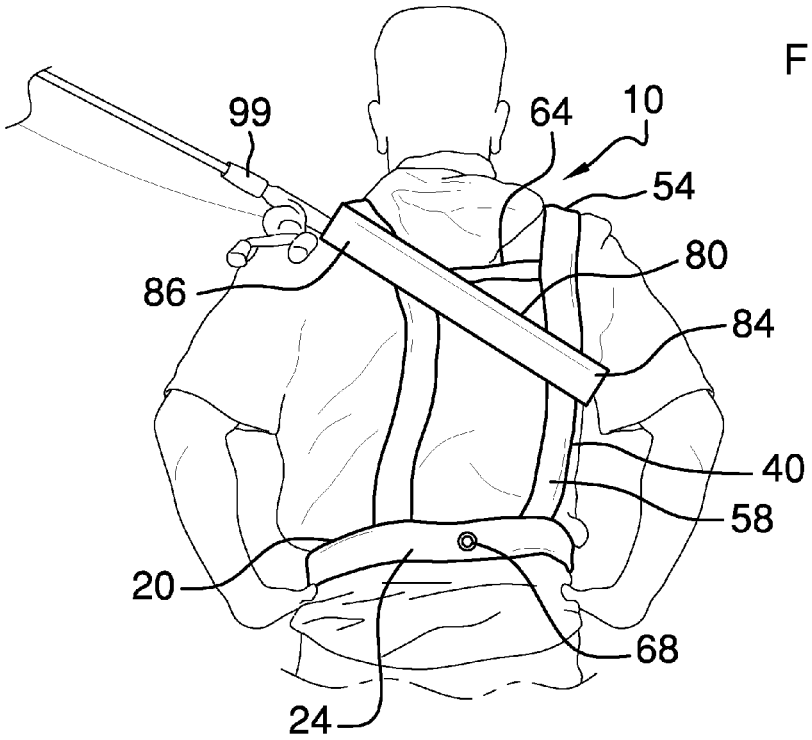
FIG. 4 is an in-use rear elevation view.
Figure 5:
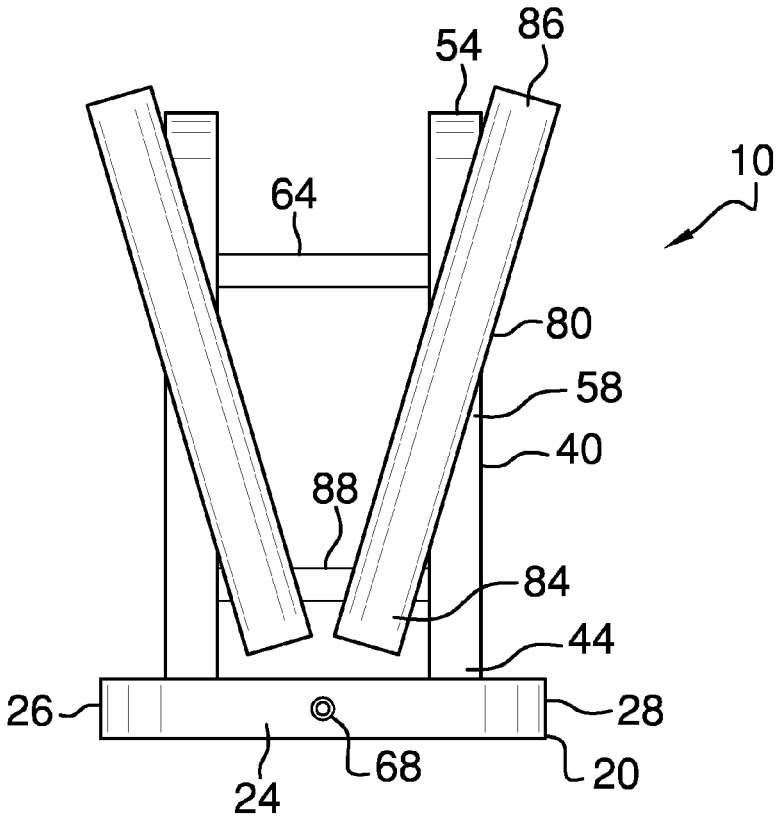
FIG. 5 is a rear elevation view illustrated with a pair of holder tubes.
Figure 6:
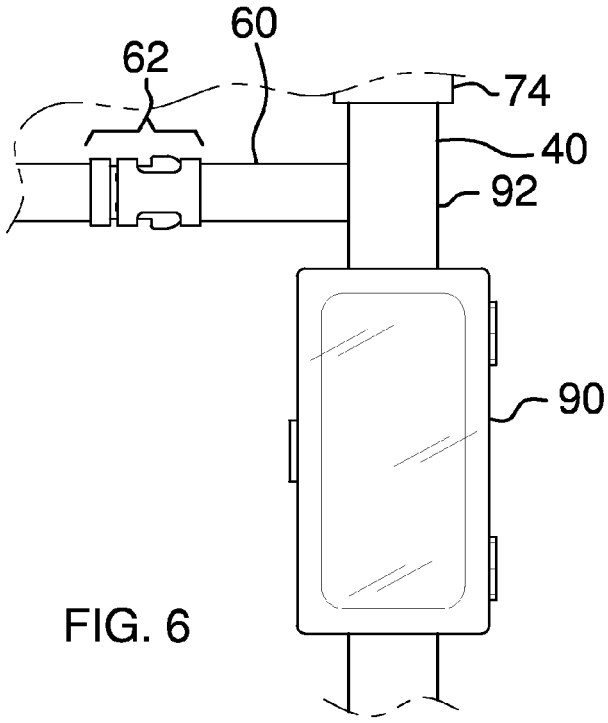
FIG. 6 is a front elevation view illustrated with a tackle box attached thereto.

With reference now to the drawings, and in particular FIGS. 1 through 6 thereof, example of the instant fishing pole holder harness employing the principles and concepts of the present fishing pole holder harness and generally designated by the reference number 10 will be described.

FIGS. 1 through 6 illustrate a preferred embodiment of the present fishing pole holder harness 10. The fishing pole holder harness 10 is designed to hold at least one fishing pole 99 at an upward angle to prevent the fishing pole 99 from slipping out of the present device. The present pole holder harness 10 includes an adjustable waist strap 20 having a front side 22, a rear side 24, a right side 26, and a left side 28. A quick-release first buckle 30 is centrally disposed on the front side 22 of the waist strap 20. A first loop 32 and a second loop 34 slidably attached to the waist strap 20 front side 22 proximal to the right side 26 and the left side 28, respectively.

The present device 10 also includes a pair of adjustable shoulder straps 40. Each shoulder strap 40 has a front end 42 and a rear end 44. The front end 42 of one of the shoulder straps 40 is attached to the first loop 32 and the front end 42 of one of the shoulder straps 40 attached to the second loop 24. The rear end 44 of each shoulder strap 40 is attached to the rear side 24 of the waist strap 20. Each shoulder strap 40 has an outer side 46, an inner side 48, a first side 50, a second side 52, and an apex 54, wherein the apex divides each of the shoulder straps 40 between a forward side 56 and a rearward side 58.

An adjustable front chest strap 60 is continuously disposed between the inner side 48 of the forward side 56 of each shoulder strap 40 in a position substantially parallel to the waist strap 20. A quick-release second buckle 62 is centrally disposed on the front chest strap 60. A first rear strap 64 is continuously disposed between the inner side 48 of the rearward side 58 of each shoulder strap 40 in a position substantially parallel to the waist strap 20. The quick-release feature of the first and second buckles 30, 62 permits the instant fishing pole holder harness 10 to be easily donned and removed.

A plurality of spaced-apart grommets 68 is disposed through the waist strap 20. At least one of the grommets 68 is disposed on each of the right side 26, the left side 28, and the rear side 24 between the shoulder straps 40. The grommets 68 provide a structure onto which fishing accessories may be attached.

A second attachment body 70, which is a buckle female portion, is disposed on the outer side 46 of each shoulder strap forward side 40 in a position above the front chest strap 60 proximal to the apex 54. A D-ring 72 is attached to a securement strap 73 having a buckle male portion 74 on an opposite end thereof. The buckle male portion 74 is removably attached to the buckle female portion 71 disposed on a lower end 76 of each second attachment body 70 to provide for the attachment of fishing accessories. A rectangular slide ring 59 is slidably disposed on the forward side 56 of each of the shoulder straps 40 between the D-ring 72 and the respective first and second loop 32, 34. Each shoulder strap 40 slidably engages the rectangular slide ring 59 to provide adjustability of a shoulder strap 40 length.

At least one hollow cylindrical holder tube 80 is attached to the rearward side 58 of the shoulder straps 40. Each holder tube 80 is continuously disposed between the shoulder straps 40 proximal to the first rear strap 64. Each holder tube 80 is positioned diagonally between the shoulder straps 40. An attachment member 82 is disposed on the rearward side 58 of each shoulder strap 40. A first end 84 of the holder tube 80 is attached to one of the attachment members 82 and an opposite second end 86 of the holder tube 80 is attached to one of the attachment members 82. One of the attachment members 82 is positioned closer to the apex 54 to position the holder tube in an upward angle. Each holder tube 80 is disposed diagonally either between the shoulder straps 40 or on one shoulder strap 40 to securely hold a fishing pole 99 therein in an elevated position against a user's body to prevent the fishing pole 99 from sliding out of the holder and to protect the fishing pole 99 from corrosive effects of saltwater and submergence, thus reducing equipment failure and replacement. Alternatively, each holder tube 80 may be attached to one attachment member 82 in a position diagonal to the shoulder strap 40 and to a second rear strap 88 disposed proximal to the waist strap 20 between the shoulder straps 20.

The present fishing pole holder harness 10 also includes a tackle box 90 attached to an attachment strap 92 having a buckle male portion 74 attached to an opposite end thereof, the buckle male portion 74 alternately removably attached to the buckle female portion 71 of the second attachment body 70, rather than one of the D-rings 72, on the forward side 56 of at least one of the shoulder straps 40 thus permitting convenient access to fishing accessories contained within the tackle box 90.

The waist strap 20 and the shoulder straps 40 are formed of high-strength 2-inch webbing. The front chest strap 60 and the first rear strap 64 are formed of high-strength 1-inch webbing. The high-strength webbing promotes durability of the instant device 10.

What is claimed is:

1. A fishing pole holder harness comprising:

an adjustable waist strap having a front side, a rear side, a right side, and a left side;

a first loop slidably attached to the waist strap front side proximal to the right side;

a second loop slidably attached to the waist strap front side proximal to the left side;

a pair of adjustable shoulder straps, each shoulder strap having a front end and a rear end, the front end of one of the shoulder straps attached to the first loop and the front end of one of the shoulder straps attached to the second loop, the rear end of each other shoulder straps attached to the rear side of the waist strap, each shoulder strap having an outer side, an inner side, a first side, a second side, and an apex, wherein the apex divides each of the shoulder straps between a forward side and a rearward side;

an adjustable front chest strap continuously disposed between the inner side of the forward side of each shoulder strap in a position substantially parallel to the waist strap;

a first rear strap continuously disposed between the inner side of the rearward side of each shoulder strap in a position substantially parallel to the waist strap;

a plurality of spaced-apart grommets disposed through the waist strap, wherein at least one of the grommets is disposed on each of the right side, the left side, and the rear side between the shoulder straps;

a second attachment body comprising a buckle female portion, wherein the second attachment body is disposed on the outer side of each shoulder strap forward side in a position above the front chest strap proximal to the apex;

a D-ring attached to a securement strap having a buckle male portion on an opposite end thereof, the buckle male portion removably attached to the buckle female portion disposed on a lower end of each of the second attachment bodies;

at least one hollow cylindrical rod holder tube attached to the rearward side of each shoulder strap, each holder tube continuously disposed between the shoulder straps proximal to the first rear strap.

2. The fishing pole holder harness of claim 1 further comprising an attachment member disposed on the rearward side of each shoulder strap, wherein a first end of the holder tube is attached to one of the attachment members and an opposite second end of the holder tube is attached to one of the attachment members.

3. The fishing pole holder harness of claim 2 wherein the holder tube is positioned diagonally between the shoulder straps.

4. The fishing pole holder harness of claim 3 further comprising a quick-release first buckle centrally disposed on the front side of the waist strap; and a quick-release second buckle centrally disposed on the front chest strap.

5. The fishing pole holder harness of claim 4 wherein the waist strap and shoulder straps are formed of 2-inch webbing; and wherein the front chest strap and the first rear strap are formed of 1-inch webbing.

6. A fishing pole holder harness comprising:

an adjustable waist strap having a front side, a rear side, a right side, and a left side;

a quick-release first buckle centrally disposed on the front side of the waist strap;

a first loop slidably attached to the waist strap front side proximal to the right side;

a second loop slidably attached to the waist strap front side proximal to the left side;

a pair of adjustable shoulder straps, each shoulder strap having a front end and a rear end, the front end of one of the shoulder straps attached to the first loop and the front end of one of the shoulder straps attached to the second loop, the rear end of each of the shoulder straps attached to the rear side of the waist strap, each shoulder strap having an outer side, an inner side, a first side, a second side, and an apex, wherein the apex divides each of the shoulder straps between a forward side and a rearward side;

an adjustable front chest strap continuously disposed between the inner side of the forward side each shoulder strap in a position substantially parallel to the waist strap;

a quick-release second buckle centrally disposed on the front chest strap;

a first rear strap continuously disposed between the inner side of the rearward side of each shoulder strap in a position substantially parallel to the waist strap;

a plurality of spaced-apart grommets disposed through the waist strap, wherein at least one of the grommets is disposed on each of the right side, the left side, and the rear side between the shoulder straps;

a second attachment body comprising a buckle female portion, wherein the second attachment body is disposed on the outer side of each shoulder strap forward side in a position above the front chest strap proximal to the apex;

a D-ring attached to a securement strap having a buckle male portion on an opposite end thereof the buckle male portion removably attached to the buckle female portion disposed on a lower end of each of the second attachment bodies;

at least one hollow cylindrical holder tube attached to the rearward side of a shoulder strap and to the first rear strap, each tube continuously disposed between the shoulder straps proximal to the first rear strap;

wherein the holder tube is positioned diagonally between the shoulder straps; and a tackle box attached to an attachment strap having a buckle male portion attached to an opposite end of the attachment strap, the buckle male portion alternately removably attached to the buckle female portion of the second attachment body.

7. The fishing pole holder harness of claim 6 further comprising an attachment member disposed on the rearward side of each shoulder strap rod tube that is movably fixed to each suspender.

8. The fishing pole holder of claim 7 wherein a first end of each holder tube is attached to one of the attachment members and an opposite second end of the holder tube is attached to one of the attachment members.

9. The fishing pole holder of claim 7 wherein each holder tube is attached to only one attachment member in a position diagonal to the shoulder strap and to a second rear strap disposed proximal to the waist strap between the shoulder straps.

10. The fishing pole holder harness of claim 8 further comprising a rectangular slide ring slidably disposed on the forward side of each of the shoulder straps between the D-ring and the respective first and second loop, wherein each shoulder strap slidably engages the rectangular slide ring.

11. The fishing pole holder harness of claim 9 further comprising a rectangular slide ring disposed on the forward side of each of the shoulder straps between the D-ring and the respective first and second loop, wherein each shoulder strap slidably engages the rectangular slide ring.

12. The fishing pole holder harness of claim 10 wherein the waist strap and shoulder straps are formed of 2-inch webbing; and wherein the front chest strap and the first rear strap are formed of 1-inch webbing.

13. The fishing pole holder harness of claim 11 wherein the waist strap and shoulder straps are formed of 2-inch webbing; and wherein the front chest strap and the first rear strap are formed of 1-inch webbing.

* * * * *